US007963266B2

(12) United States Patent
Kapinsky et al.

(10) Patent No.: US 7,963,266 B2
(45) Date of Patent: Jun. 21, 2011

(54) STARTER APPARATUS FOR AN INTERNAL COMBUSTION ENGINE

(75) Inventors: Ulrich Kapinsky, Waiblingen (DE); Roland Schmidt, Schwaikheim (DE); Florian v. Krane, Kirchberg/Murr (DE); Alfred Bothner, Walheim (DE); Manfred Rabis, Schwaikheim (DE); Heiko Stöcker, Esslingen (DE)

(73) Assignee: Andreas Stihl AG & Co. KG, Waiblingen (DE)

( * ) Notice: Subject to any disclaimer, the term of this patent is extended or adjusted under 35 U.S.C. 154(b) by 191 days.

(21) Appl. No.: 12/320,603

(22) Filed: Jan. 30, 2009

(65) Prior Publication Data

US 2009/0194057 A1 Aug. 6, 2009

(30) Foreign Application Priority Data

Feb. 2, 2008 (DE) ..... 10 2008 007 291

(51) Int. Cl.
*F02N 1/00* (2006.01)

(52) U.S. Cl. ..... 123/185.3; 123/185.14; 123/185.2

(58) Field of Classification Search ..... 123/185.1, 123/185.14, 185.2, 185.3
See application file for complete search history.

(56) References Cited

U.S. PATENT DOCUMENTS

| | | | | |
|---|---|---|---|---|
| 6,588,390 | B2 * | 7/2003 | Kawasaki et al. | 123/185.3 |
| 6,981,482 | B2 | 1/2006 | Tsunoda et al. | |
| 7,267,091 | B2 * | 9/2007 | Arnold et al. | 123/185.14 |
| 7,658,176 | B2 * | 2/2010 | Fattorusso et al. | 123/185.3 |
| 2002/0174848 | A1 * | 11/2002 | Nieda et al. | 123/185.14 |
| 2003/0213455 | A1 * | 11/2003 | Tohyama | 123/185.3 |
| 2004/0123827 | A1 * | 7/2004 | Tsunoda et al. | 123/185.3 |
| 2006/0070596 | A1 * | 4/2006 | Horikoshi | 123/185.3 |

* cited by examiner

*Primary Examiner* — Willis R Wolfe, Jr.
*Assistant Examiner* — Anthony L Bacon
(74) *Attorney, Agent, or Firm* — Walter Ottesen

(57) ABSTRACT

A starter device for an internal combustion engine (10) has an actuating device and an entrainer (24) can be coupled to the crankshaft (13) of the engine (10). The entrainer (24) and the actuating device are rotatably journalled about a rotational axis (14). The entrainer (24) and the actuating device are connected to each other via a damping spring (23). The damping spring (23) is connected with a first end (26) to the actuating device and with a second end (27) to the entrainer (24). The entrainer (24) and the actuating device have respective supports (21, 42). The damping spring (23) is mounted on the outer periphery of the two supports (21, 42). In the direction of the rotational axis (14), a disc (22) is mounted between the two supports (21, 42) in order to avoid the situation that the damping spring (23) can force itself into a gap between the two supports (21, 42) which gap can arise during operation.

19 Claims, 3 Drawing Sheets

STARTER APPARATUS FOR AN INTERNAL COMBUSTION ENGINE

CROSS REFERENCE TO RELATED APPLICATION

This application claims priority of German patent application no. 10 2008 007 291.5, filed Feb. 2, 2008, the entire content of which is incorporated herein by reference.

FIELD OF THE INVENTION

The invention relates to a starter apparatus for an internal combustion engine and especially a starter apparatus in a portable handheld work apparatus such as a motor-driven chain saw, cutoff machine, brushcutter or the like.

BACKGROUND OF THE INVENTION

U.S. Pat. No. 6,981,482 discloses a starter apparatus wherein the damping spring is mounted on supports on the entrainer and on a rope reel. The supports lie one next to the other. It has been shown that the entrainer can tilt slightly relative to the rope reel because of the forces which arise during operation so that a gap occurs between the entrainer and the rope reel. This gap can also occur because of manufacturing tolerances. During operation, the damping spring can force its way into this gap and this can lead to a fracture of the damping spring.

SUMMARY OF THE INVENTION

It is an object of the invention to provide a starter apparatus of the kind described above which has a high operational reliability and durability.

The starter apparatus of the invention is for an internal combustion engine having a crankshaft. The starter apparatus includes: an actuating unit to which rotation is imparted for starting the engine; an entrainer; the actuating unit and the entrainer being rotatably journalled about a rotational axis; a coupling device for coupling the entrainer to the crankshaft; a damping spring connecting the actuating unit and the entrainer to each other; the damping spring having a first end connected to the actuating unit and a second end connected to the entrainer; the entrainer and the actuating unit having first and second supports, respectively; the first and second supports having first and second outer peripheries, respectively, for accommodating the damping spring thereon; and, at least one of the supports having a plurality of recesses formed in the outer periphery thereof.

According to the invention, at least one support has recesses on its outer periphery in order to prevent a non-uniform contact of the damping spring on the support because of contamination on the support. During operation, the recesses serve as dirt collection spaces and ensure a good contact of the damping spring on the regions of the support remaining between the recesses. The recesses are advantageously arranged so as to be uniformly distributed on the outer periphery of the support. The recesses can, for example, be configured as slots running in the longitudinal direction of the support. A large number of recesses with comparatively narrow widths is provided to obtain a good contact of the damping spring on the support.

A disc is advantageously arranged between the supports in the direction of the rotational axis. The disc, which is mounted between the two supports, can be so selected that tolerances between the entrainer and the actuating device are compensated so that the formation of a gap into which the damping spring can force itself during operation can be mostly avoided. The disc can be manufactured and mounted in a simple manner so that a simple assembly of the starter apparatus is preserved.

Advantageously, the two supports have the same outer diameter which corresponds especially to the outer diameter of the disc. In this way, a cylindrical support surface for the damping spring is provided against which the damping spring can lie. The cylindrical support surface is formed by the two supports and the disc. Jumps in diameter which can lead to a notching action on the spring are avoided. The supports advantageously lie with their radially outward regions on opposite-lying sides of the disc. Because the supports lie against the disc, a formation of a gap in the radially outer regions of the supports, on which the damping spring is wound, can be avoided. Also, a tilting of the support of the entrainer relative to the support of the actuating device can be avoided by the contact against the disc. During operation, the two supports rotate relative to each other. For hooking in the spring, the supports can be provided with recesses at their outer periphery. If both supports lie directly one against the other with their outer region, then an unwanted hooking or jamming of the two supports can occur in the region of the recesses. This is reliably avoided by the disc mounted between the supports.

Advantageously, the disc is held on one of the supports so as to rotate therewith. In this way, a defined friction pair results between the other support and the disc. The disc is held especially force tight on the support. Advantageously, the disc is mounted on at least one shoulder on one of the supports. The disc can also be mounted on shoulders of the two supports. The disc can be press fitted on a support to provide a force-tight fixation. In this way, no additional components are needed for fixing the disc on the support. It can, however, also be provided that the disc is journalled with radial play.

The actuating unit and the entrainer are journalled on a bearing shaft in the region of the supports. Advantageously, the supports have an outer region on which the damping spring is mounted and an inner region for mounting on the bearing shaft. The outer region and the inner region can, for example, be connected to each other via struts. The supports can also be formed of full material and the outer region is formed on the outer surface and the inner region is formed on the inner surface.

To ensure that the outer regions each can lie against the disc, the supports are at a distance from each other at their inner regions in the axial direction of the bearing shaft. The tolerances of the entrainer and actuating unit are so selected that the contact always takes place at the outer region when the struts are in axial contact because of the spacing of the inner regions. A gap between the two supports and the disc can thereby substantially be avoided. Advantageously, the disc is held on an inner region of at least one of the supports. The disc advantageously has a constant thickness over its entire area.

The damping spring is advantageously configured as a helical spring having essentially constant diameter of the turns. In this way, the helical spring can lie against the supports of the entrainer and actuating unit over its entire length. The damping spring is advantageously held with a first end on the actuating unit and with a second end on the entrainer. The first end is bent over inwardly as is the second end. The structural space facing outwardly can be held small because of the fixation of the damping spring at its inwardly bent ends. The recesses on the supports of the entrainer and the actuating unit, which are needed for assembling the ends of the damping spring, are closed by the disc. If the disc is held tightly at one of the supports then the disc fixes one end of the damping spring in the direction of the rotational axis. In this way, an unintended dropping off of the damping spring during assembly can be avoided and the assembly is simplified.

The damping spring is configured to be even at its inner periphery so that a high resistance torque of the spring is obtained with a low structural size. At the same time, the even inner periphery causes the spring to lie well on the supports. The damping spring has especially a rectangular wire cross section. In this way, a low volume of the damping spring results with a high spring rate.

Advantageously, the coupling device includes pivotally journalled pawls on the entrainer which coact with a cam contour for coupling the starter apparatus to the crankshaft of the internal combustion engine. The cam contour is fixedly connected to the crankshaft so as to rotate therewith. The actuating unit is especially a rope reel to which rotation is imparted manually via a starter rope. The suggested configuration of a starter apparatus can, however, also be advantageous for starter units which are driven via an electric motor. The internal combustion engine is especially the drive motor in portable handheld work apparatus. The starter unit is well suited for use in portable handheld work apparatus because the starter unit has a simple configuration and is therefore of low weight.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
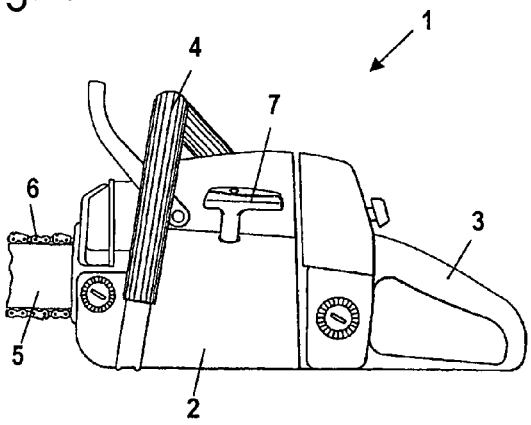
FIG. 1 is a schematic side elevation view of a motor-driven chain saw.

FIG. 1 shows a motor-driven chain saw by way of example for a portable handheld work apparatus. The starter apparatus can, however, also be utilized in other portable handheld work apparatus such as cutoff machines, brushcutters or the like. The motor-driven chain saw 1 has a housing 2 on which a rearward handle 3 and a grab tube 4 are arranged for guiding the motor-driven chain saw. A guide bar 5 projects forwardly at the end of the housing 2 lying opposite the rearward handle 3. A saw chain 6 is driven so as to move about the periphery of the guide bar 5. A starter handle 7 projects from the housing 2.

Figure 2:
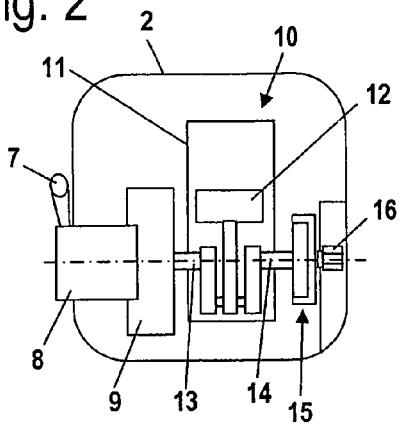
FIG. 2 is a schematic section view taken through the motor-driven chain saw of FIG. 1.

As shown in FIG. 2, the starter handle 7 serves for actuating a starter apparatus 8. The starter apparatus 8 can be coupled to a fan wheel 9 of the chain saw 1 via a coupling device not shown in FIG. 2. The fan wheel 9 is fixedly connected to a crankshaft 13 of the internal combustion engine 10 so as to rotate therewith. The engine 10 functions to drive the saw chain 6 about the periphery of the guide bar. The engine 10 has a cylinder 11 wherein a piston 12 is journalled for reciprocal movement. The piston 12 drives the crankshaft 13 so that it rotates about a rotational axis 14. At the end of the engine 10 lying opposite the fan wheel 9 and the starter apparatus 8, the crankshaft 13 is connected to a drive sprocket 16 for the saw chain 6 via a centrifugal clutch 15. The engine 10 is advantageously a two-stroke engine and especially a two-stroke engine operating with a scavenging charge. The engine 10 can, however, also be a four-stroke engine and especially a mixture-lubricated four-stroke engine.

Figure 3:
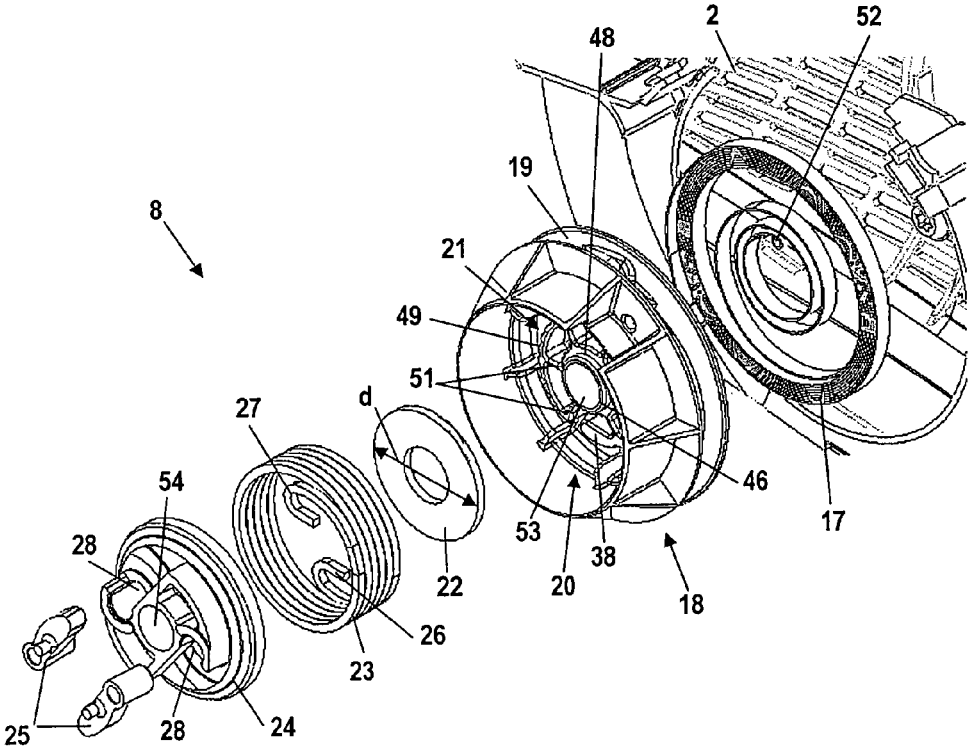
FIG. 3 is a perspective exploded view of the starter apparatus of the motor-driven chain saw of FIG. 1.
Figure 6:
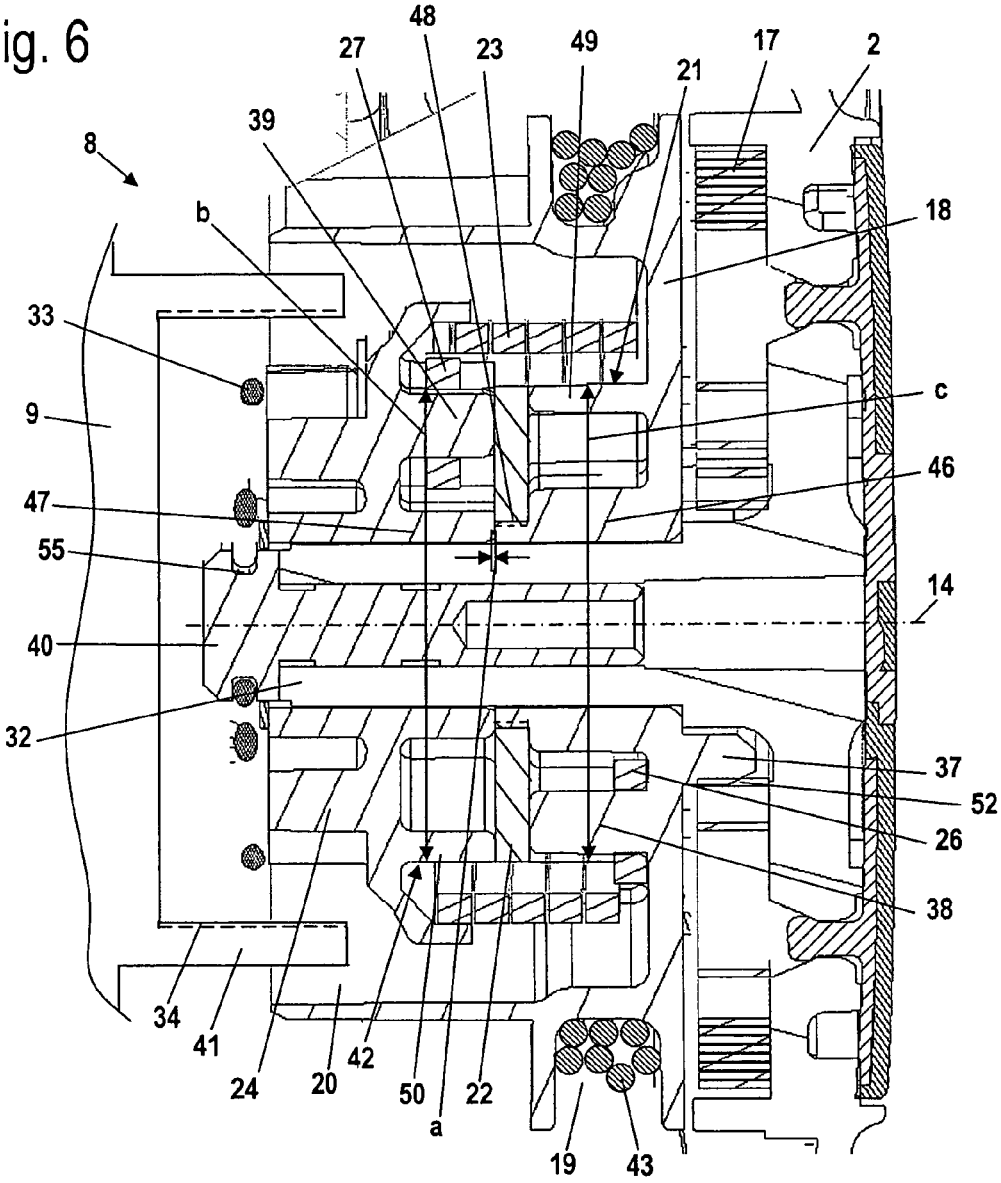
FIG. 6 is a section view taken through the starter apparatus of FIG. 3.

In FIG. 3, the starter apparatus 8 is shown in detail. The starter apparatus 8 includes a return spring 17 which is mounted next to the wall of the housing 2 on the housing 2. The return spring 17 is configured as a spiral spring. The return spring 17 is connected with its inner end 52 to a rope reel 18. The rope reel 18 has a slot 19 wherein a starter rope 43, which is shown in FIG. 6, is wound. The starter rope 43 is, with one end, connected to the rope reel 18 and, with the other end, to the starter handle 7 so that rotation can be imparted to the rope reel 18 by manually pulling the starter handle 7.

The rope reel 18 has a receiving space 20 on the side facing away from the return spring 17 wherein a support 21 is arranged. The support 21 has an inner region 46, which serves to journal the rope reel 18, and an outer region 49 whereat a damping spring 23 is mounted. The damping spring 23 can be designed as a starter spring and a starting of the engine is therefore possible with the energy stored in the damping spring 23. The damping spring 23 has a first end 26 which is bent inwardly to form a hook shape. With this first end 26, the damping spring 23 is hooked into a wall section 38 of the outer region 49. The inner region 46 and the outer region 49 are each configured to be approximately cylindrical and are connected to each other by a series of reinforcing struts 51. The support 21 can, however, also be made of solid material. A shoulder 48 is provided at the inner region 46. A disc 22 is fixedly held on the shoulder 48 so as to rotate therewith. The disc 22 is pressed upon the shoulder 48 so that the disc is held force tight. The disc 22 has a constant, very small thickness referred to the outer diameter (d) of the disc 22.

The damping spring 23 is configured as a helical spring having a constant outer diameter. The spring wire of the damping spring 23 has a rectangular cross section. The damping spring 23 has a second end 27 which lies facing toward an entrainer 24 of the starter apparatus 8. The second end 27 is likewise bent over inwardly to provide a hooked shape and is hooked into a support (not shown in FIG. 3) of the entrainer 24. On the end facing away from the damping spring 23, the entrainer 24 has two receptacles 28 wherein respective pawls 25 are pivotally journalled. The pawls 25 serve to couple to the fan wheel 9. As shown in FIG. 3, the rope reel 18 has a center opening 53 and the entrainer 24 has a center opening 54. Both openings (53, 54) have approximately the same diameter.

Figure 4:
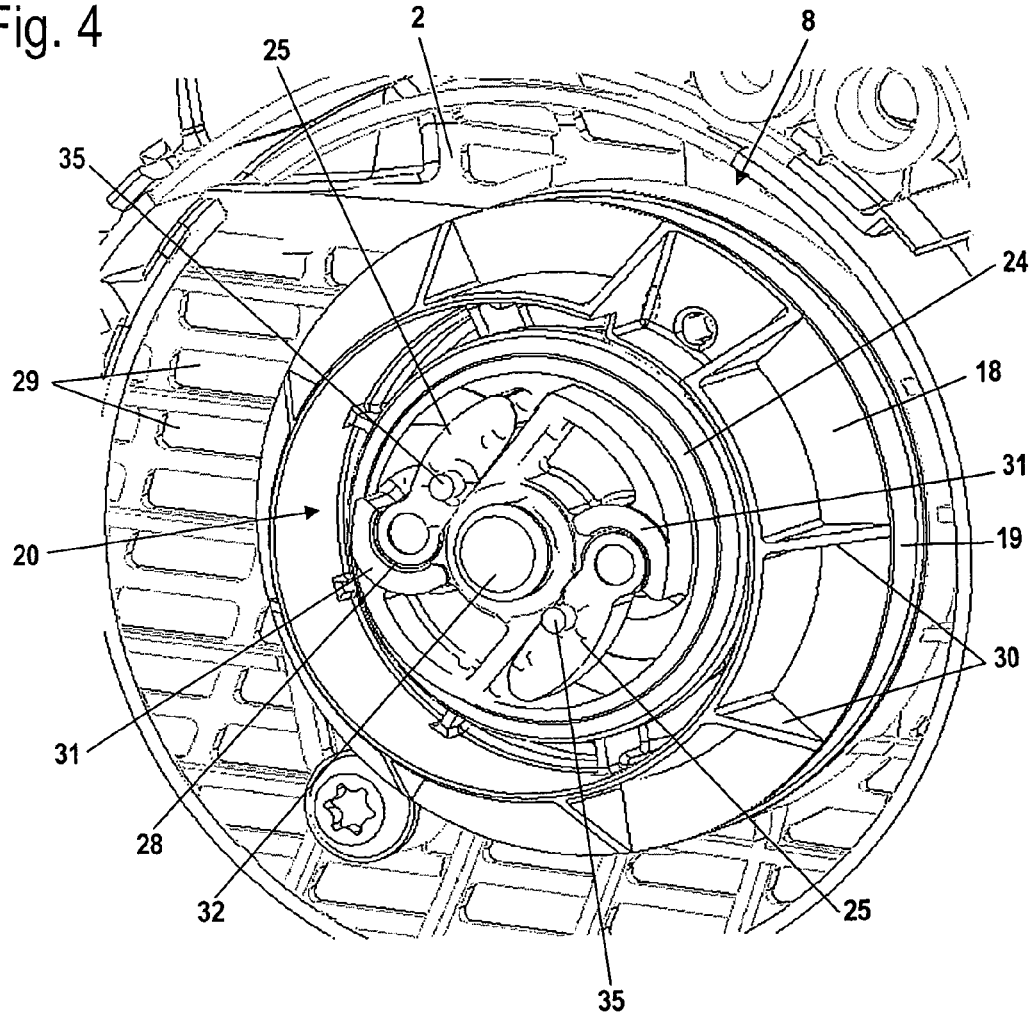
FIG. 4 is a perspective view of the starter unit.

In FIG. 4, the starter apparatus 8 is shown in the assembled state. The rope reel 18 and the entrainer 24 are mounted on a bearing shaft 32 which projects through the openings 53 and 54 of the rope reel 18 and of the entrainer 24. The rope reel 18 and the entrainer 24 are rotatably journalled on the bearing shaft 32 for rotation about the rotational axis 14. As shown in FIG. 4, the receptacles 28 for the pawls 25 are delimited by wall sections 31 which surround the pawls 25 with a partial circle. Each pawl 25 has an actuating lug 35 which can effect an outpivoting of the pawls 25. As shown also in FIG. 4, the rope reel 18 has reinforcing webs 30 next to the slot 19 on the outer side of the slot 19. The housing 2 has a plurality of cooling air openings 29 in the region of the starter apparatus 8 through which the cooling air for the engine 10 is moved into the interior of the housing 2 by the fan wheel 9.

Figure 5:
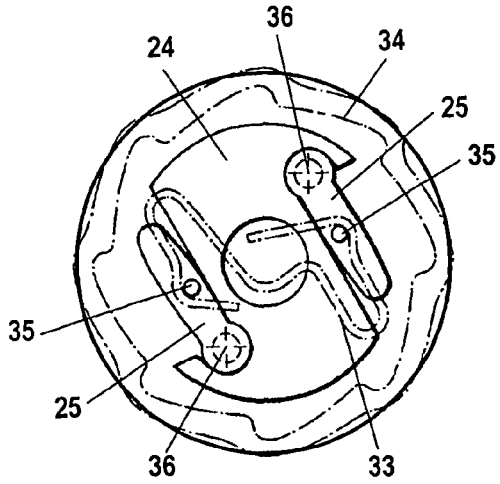
FIG. 5 is a schematic of the coupling device of the starter apparatus.

In FIG. 5, the actuation of the coupling device is shown schematically. The pawls 25 are held on the bearing shaft 32 via a spring clamp 33. The spring clamp 33 has a cam contour. With the movement of the entrainer 24 relative to the bearing shaft 32, the lugs 35 move in the spring clamp 33 because the spring clamp 33 is clampingly held friction tight on the bearing shaft 32. The pawls 25 are pivoted outwardly because of the contour of the spring clamp 33. The pawls 25 pivot about the pivot axes 36 which lie in the region of the receptacles 28. The fan wheel has a cam contour 34 in which the pawls 25 engage in the pivoted-out state. This achieves a rotation-tight coupling of the entrainer 24 to the fan wheel 9 and therefore to the crankshaft 13 of the engine 10.

FIG. 6 shows the configuration of the starter apparatus 8 in detail. The outer end of the return spring 17 is fixed on the housing 2. The inner end 52 is mounted on a lug 37 which is formed on the side of the rope reel 18 facing toward the housing 2. The support 21 of the rope reel 18 is journalled on the bearing shaft 32 with the inner region 46. The damping spring 23 is mounted radially outside of the outer region 49. In the region of the wall section 38, whereat the first end 26 of the damping spring 23 is held, the wall of the outer region 49 is offset slightly inwardly. At its outer region 49, the support 21 has an outer diameter (c) which corresponds to the outer diameter (d) of the disc 22. In the outer region 49, the support 21 lies tightly against the disc 22. In the inner region 46, the support 21 is provided with a shoulder 48 and is set back by a slight distance (a) relative to the side of the disc 22 facing toward the entrainer 24.

As shown in phantom outline in FIG. 6, the outer diameter of the shoulder 48 can also be less than the inner diameter of the disc 22 so that the disc 22 is not tightly mounted and is instead mounted loosely with radial play on the shoulder 48. The disc 22 is then held in its position by the support 21 of the rope reel 18 and the support 42 of the entrainer 24 and is secured in axial and radial directions. A distortion of the entrainer 24, which can occur when pressing on the disc, can be avoided because of the play between the disc 22 and the shoulder 48.

As shown in FIG. 6, the entrainer 24 has a support 42 which has an inner region 47 and an outer region 50. The inner region 47 lies against the disc 22. It can, however, also be provided that the inner region 47 is at an axial distance to the disc 22. The inner region 47 of the entrainer 24 has a distance (a) to the inner region 46 of the support 21 of the rope reel 18. The support 42 lies against the disc 22 at the outer region 50. The contact against the disc 22 can be ensured because of the spacing (a) of the inner regions 46 and 47. For fixing the second end 27 of the damping spring 23, the outer region 50 has a wall section 39 on which the second end 27 is hooked in. The wall section 39 is also set back slightly relative to the outer diameter of the support 42.

The support 42 has an outer diameter (b) which corresponds to the outer diameter (d) of the disc 22 and the outer diameter (c) of the support 21. In this way, there results a cylindrical support surface with an almost constant outer diameter for the damping spring 23. Because the two ends 27 and 26 are hooked in, the supports 21 and 42 each have a longitudinal slit on their outer periphery. These two longitudinal slits are separated from each other by the disc 22 so that a hooking of the longitudinal slits during operation is avoided. Because the supports 21 and 42 each lie against the smoothly configured disc 22 at their outer regions 49 and 50, a tight contact in this region is provided without the danger of an unwanted hooking.

As shown in FIG. 6, the fan wheel 9 has a peripheral collar 41 whereat the cam contour 34 is formed. The collar 41 projects into the receiving space 20 of the rope reel 18 so that the pawls 25 (not shown in FIG. 6) can engage in the cam contour 34. FIG. 6 shows that a holding bolt 40 is arranged on the bearing shaft 32 and this holding bolt 40 can, for example, be threadably engaged in the bearing shaft 32. The holding bolt 40 has a peripherally-extending slot 55 for the spring clamp 33. The starter apparatus 8 is fixed on the bearing shaft 32 by the spring clamp 33.

Figure 7:
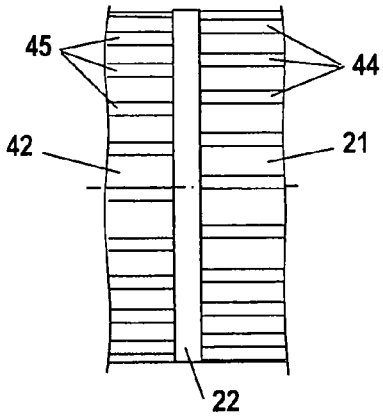
FIG. 7 is a schematic side elevation view of the supports of the starter apparatus.

The shape of the outer periphery of the supports 21 and 42 is shown in FIG. 7. A series of recesses (44, 45) are provided on the supports (21, 42), respectively. These recesses (44, 45) are formed as slots running in the direction of the rotational axis 14. The rotational axis 14 corresponds to the rotational axis of the crankshaft 13 and the longitudinal axis of the bearing shaft 32. The rotational axis 14 is the rotational axis for the rope reel 18 and the entrainer 24. A plurality of recesses (44, 45) are provided on the outer periphery of the supports 21 and 42, respectively, and they are uniformly distributed over the periphery. Approximately 3 to approximately 40 recesses and especially approximately 15 to approximately 35 recesses are seen to be advantageous. Twenty-four recesses are provided in the embodiment. The sections between mutually adjacent ones of the recesses (44, 45) can advantageously correspond to the width of the individual recesses (44, 45). The depth of the recesses (44, 45) can be small and can be, for example, approximately 0.2 mm to approximately 2 mm, especially approximately 0.5 mm. The depth of the recesses (44, 45) advantageously corresponds approximately to the thickness of the damping spring 23. During operation, dirt, which collects in the starter apparatus 8, can deposit in the recesses (44, 45) so that the contact of the damping spring 23 on the supports 21 and 42 is not hindered by the dirt.

During operation, the support 42 moves relative to the disc 22 because the disc 22 is fixedly held on the support 21. The material of the support 42 is so matched to the material of the disc 22 that a good friction pairing results. Advantageously, the support 42 and the disc 22 are made of plastic, especially, of POM. The rope reel 18 is also advantageously made of plastic, especially, POM. The disc 22 can also be made of PA or a metal.

The disc 22 can be mounted loosely between the two supports 21 and 42. In this case, a gap arises during operation between the two supports 21 and 42 and this gap is subdivided into two gaps having reduced width by the disc 22. In this way too, a penetration of the damping spring 23 into a gap between the components is made difficult or prevented.

Figure 8:
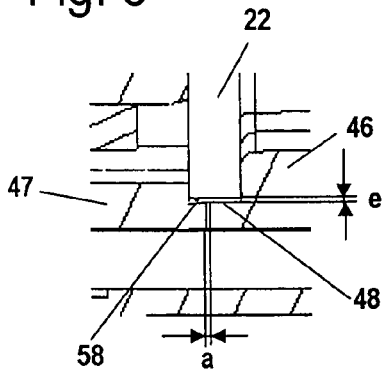
FIG. 8 is a section view of a detail of the embodiment of the starter apparatus of FIG. 6.

In FIG. 8, an embodiment for the journaling of the disc 22 is shown. The shoulder 48, which is configured on the inner region 46 of the support 21, is configured to be shorter compared to the embodiment in FIG. 6. A shoulder 58 is arranged on the inner region 47 of the support 42. The disc 22 lies on both shoulders (48, 58). A distance (a) is disposed between the two shoulders 48 and 58 so that a gap is formed between the two shoulders 48 and 58 which is bridged by the disc 22. In FIG. 8, the shoulder 58 is configured shorter than the shoulder 48. The two shoulders can, however, have the same length. Also, the shoulder 48 can be shorter than the shoulder 58.

The outer diameter of the shoulders 48 and 58 is equal to or less than the inner diameter of the disc 22. In this way, a distance (e) between the shoulders (48, 58) and the disc 22 is formed in the radial direction. The disc 22 is thereby held on the shoulders 48 and 58 with radial play.

It is understood that the foregoing description is that of the preferred embodiments of the invention and that various changes and modifications may be made thereto without departing from the spirit and scope of the invention as defined in the appended claims.

What is claimed is:

1. A starter apparatus for an internal combustion engine having a crankshaft, the starter apparatus comprising:

an actuating unit to which rotation is imparted for starting said engine;

an entrainer;

said actuating unit and said entrainer being rotatably journalled about a rotational axis;

a coupling device for coupling said entrainer to said crankshaft;

a damping spring connecting said actuating unit and said entrainer to each other;

said damping spring having a first end connected to said actuating unit and a second end connected to said entrainer;

said entrainer and said actuating unit having first and second supports, respectively;

said first and second supports having first and second outer peripheries, respectively, for accommodating said damping spring thereon; and, a disc mounted between said first and second supports in the direction of said rotational axis.

2. The starter apparatus of claim 1, wherein at least one of said supports has a plurality of recesses formed in the outer periphery thereof; and, said recesses are distributed uniformly over the outer periphery of said one support.

3. The starter apparatus of claim 1, wherein said first and second supports have the same outer diameters (b, c); and, said disc has an outer diameter (d) corresponding to said outer diameters (b, c) of said first and second supports.

4. The starter apparatus of claim 1, wherein said first and second supports have respective radial outer regions which lie in contact engagement with opposite-lying sides of said disc.

5. The starter apparatus of claim 1, wherein said disc is fixedly mounted on one of said first and second supports so as to rotate therewith.

6. The starter apparatus of claim 5, wherein said disc is held force tight on said one of said first and second supports.

7. The starter apparatus of claim 1, wherein one of said first and second supports has a shoulder formed thereon; and, said disc is mounted on said shoulder.

8. The starter apparatus of claim 1, further comprising a bearing shaft; and, said entrainer and said actuating unit being mounted on said bearing shaft in the region of said first and second supports.

9. The starter apparatus of claim 8, wherein each of said supports has an outer region for accommodating said damping spring thereon and an inner region for mounting on said bearing shaft.

10. The starter apparatus of claim 9, wherein said first and second supports are disposed at a spacing (a) from each other at the inner regions thereof viewed in the axial direction of said bearing shaft.

11. The starter apparatus of claim 10, wherein said disc is held at the inner region of at least one of said first and second supports.

12. The starter apparatus of claim 1, wherein said damping spring is configured as a helical spring having an essentially constant turns diameter.

13. The starter apparatus of claim 1, wherein said first end of said damping spring is bent inwardly and said damping spring is held on said actuating unit with said first end; and, said second end of said damping spring is bent inwardly and said damping spring is held on said entrainer with said second end.

14. The starter apparatus of claim 1, wherein said disc fixes one of said ends Of said damping spring in the direction of said rotational axis.

15. The starter apparatus of claim 1, wherein said damping spring is configured to be even on its inner periphery.

16. The starter apparatus of claim 1, wherein said coupling device comprises a cam contour fixedly connected to said crankshaft so as to rotate therewith; and, pawls pivotally mounted on said entrainer for coacting with said cam contour to couple said starter apparatus to said crankshaft.

17. The starter apparatus of claim 1, wherein said actuating unit comprises a rope reel accommodating a pull rope which is pulled manually to impart rotation to said actuating unit.

18. The starter apparatus of claim 1, wherein said engine is the drive motor in a portable handheld work apparatus.

19. A starter apparatus for an internal combustion engine having a crankshaft, the starter apparatus comprising;

an actuating unit to which rotation is imparted for starting said engine;

an entrainer;

said actuating unit and said entrainer being rotatably journalled about a rotational axis;

a coupling device for coupling said entrainer to said crankshaft;

a damping spring connecting said actuating unit and said entrainer to each other;

said damping spring having a first end connected to said actuating unit and a second end connected to said entrainer;

said entrainer and said actuating unit having first and second supports, respectively;

said first and second supports having first and second outer peripheries, respectively, for accommodating said damping spring thereon;

at least one of said supports having a plurality of recesses formed in the outer periphery thereof; and, a disc mounted between said first and second supports in the direction of said rotational axis.

* * * * *